US006139399A

United States Patent [19]

DeAngelis

[11] Patent Number: 6,139,399

[45] **Date of Patent: *Oct. 31, 2000**

[54] SYSTEM FOR, AND OF, MAINTAINING OPERATIVE VOLTAGE LEVELS IN A TOY VEHICLE MOVEMENTS

[76] Inventor: Peter C. DeAngelis, 2430 Torrejon Pl., Carlsbad, Calif. 92009

[ * ] Notice: This patent issued on a continued prosecution application filed under 37 CFR 1.53(d), and is subject to the twenty year patent term provisions of 35 U.S.C. 154(a)(2).

[21] Appl. No.: 09/017,922

[22] Filed: Feb. 3, 1998

[51] Int. Cl.[7] ..... A63H 29/22; A63H 30/04

[52] U.S. Cl. ..... 446/484; 446/456; 463/39

[58] Field of Search ..... 446/456, 484, 446/454, 455, 431, 457, 465, 467, 485; 463/36, 37, 39

[56] References Cited

U.S. PATENT DOCUMENTS

| | | | |
|---|---|---|---|
| 4,143,307 | 3/1979 | Hansen et al. | 446/454 X |
| 4,168,468 | 9/1979 | Mabuchi et al. | 446/454 X |
| 4,207,502 | 6/1980 | Omura | 446/454 X |
| 4,356,439 | 10/1982 | Mott et al. | 318/685 |
| 4,380,334 | 4/1983 | Minkoff et al. | 273/1 E |
| 4,395,760 | 7/1983 | Soski et al. | 364/410 |
| 4,938,483 | 7/1990 | Yavez | 446/454 X |
| 5,083,968 | 1/1992 | Hart | 446/431 |
| 5,743,347 | 4/1998 | Gingerich | 180/65.1 |
| 5,760,703 | 6/1998 | Becker | 340/825.69 |
| 5,865,661 | 2/1999 | Cyrus et al. | 446/136 |

OTHER PUBLICATIONS

Fundamentals of Electrical Engeneering, Bobrow, University of Massachusetts, Oxford, New York, p. 401 +, Dec. 1996.

*Primary Examiner*—D. Neal Muir

*Attorney, Agent, or Firm*—Fulwider Patton Lee & Utecht, LLP; Ellsworth R. Roston

[57] ABSTRACT

A vehicle may have a chassis, wheels rotatably mounted on the chassis and motors disposed on the vehicle for selectively rotating the wheels to (a) accelerate the vehicle forwardly and rearwardly, (b) spin-turn the vehicle (turn the vehicle on a substantially stationary position), (c) turn the vehicle to the right or left during the vehicle movement forwardly or rearwardly, and (d) move the vehicle forwardly or rearwardly at a substantially constant speed. Energy is introduced from a battery in the vehicle to an energy storage member (e.g. capacitor) in the vehicle and from the capacitor to a microprocessor in the vehicle. The microprocessor controls the operation of the vehicle motor(s) in performing individual ones of the movements specified in (a) to (d) above. In accordance with the microprocessor operation, energy is introduced to the vehicle motors on a pulse width modulation basis where the pulse width in each modulation at each instant is dependent upon the operations of the motor(s) in performing individual ones of the motor movements specified in (a) to (d) above. For each vehicular speed of movement, the pulse widths of the energy modulations introduced to the motor(s) are greater for the movement (a) than for the movement (b), greater for the movement (b) than for the movement (c) and greater for the movement (c) than for the movement (d). In this way, the operative voltage levels are maintained.

24 Claims, 3 Drawing Sheets

SYSTEM FOR, AND OF, MAINTAINING OPERATIVE VOLTAGE LEVELS IN A TOY VEHICLE MOVEMENTS

This invention relates to systems for, and methods of, providing energy from a battery to obtain controlled movements of a toy vehicle under a variety of different operating parameters.

BACKGROUND OF THE INVENTION

Toy vehicles are subjected to different types of movement. For example, toy vehicles may be (a) subjected to accelerations in forward and rearward directions, (b) spin-turning (spinning in revolutions in a substantially stationary position), (c) turning while moving horizontally in the forward or rearward directions and (d) movements in the forward or rearward direction at a substantially constant speed.

Each toy vehicle is generally powered by a battery which has a limited life and which has a limited voltage. Some of the movements specified in the previous paragraph require considerably more power from the battery than others of such specified movements. The toy vehicles may be subjected to the individual types of movements in accordance with controls provided by a microprocessor. The operation of the microprocessor may be provided by power from the battery. However, the drain of energy from the battery may sometimes become so great, such as during periods of starting and/or acceleration of the toy vehicle at high rates, that the microprocessor does not receive sufficient energy from the battery to operate properly in controlling the movements of the toy vehicle. This results, from increased current flows through a resistance in the battery during the times that the vehicle is being started or is being accelerated. Such a resistance particularly occurs in alkaline batteries.

Attempts have been made in the prior art to assure that the microprocessor will receive sufficient energy to provide for proper movements of the toy vehicle even when the vehicle is being started or is being accelerated at high rates. For example, an energy storage member such as a capacitor has been connected across the battery to receive and store energy from the battery. Such energy has been introduced to the microprocessor so that the microprocessor will provide for the desired movements of the toy vehicle even when the toy vehicle is being started or being accelerated at high rates. However, even when the energy storage member has been connected across the microprocessor, the microprocessor has sometimes not received a sufficient voltage from the energy storage member to obtain and/or maintain the desired movements of the toy vehicle.

BRIEF DESCRIPTION OF THE INVENTION

This invention provides a system for controlling the operation of motors for moving a toy vehicle in accordance with controls provided by a microprocessor. The system of this invention assures that, regardless of the drain imposed on a battery by the motors in moving the toy vehicle, the microprocessor will receive a voltage of sufficient magnitude to obtain a proper operation of the microprocessor in controlling the movements of the toy vehicle.

In one embodiment of the invention, a vehicle may have a chassis, wheels rotatably mounted on the chassis and motors disposed on the vehicle for selectively rotating the wheels to (a) accelerate the vehicle forwardly and rearwardly, (b) spin-turn the vehicle (turn the vehicle on a substantially stationary position), (c) turn the vehicle to the right or left during the vehicle movement forwardly or rearwardly, and (d) move the vehicle forwardly or rearwardly at a substantially constant speed.

Energy is introduced from a battery in the vehicle to an energy storage member (e.g. capacitor) in the vehicle and from the capacitor to a microprocessor in the vehicle. The microprocessor controls the operation of the vehicle motors in performing individual ones of the movements specified in (a) to (d) above. In accordance with the microprocessor operation, energy is introduced to the vehicle motors on a pulse width modulation basis where the pulse width in each modulation at each instant is dependent upon the operations of the motors in performing individual ones of the vehicle movements specified in (a) to (d) above.

For each vehicular speed of movement, the pulse widths of the energy modulations introduced to the motor are greater for the movement (a) than for the movement (b), greater for the movement (b) than the movement (c) and greater for the movement (c) than for the movement (d). Energy is introduced from the battery to the capacitor but is prevented from passing from passing from the capacitor to the battery.

In this way, operative voltage levels are maintained.

DETAILED DESCRIPTION OF THE INVENTION

Figure 1:
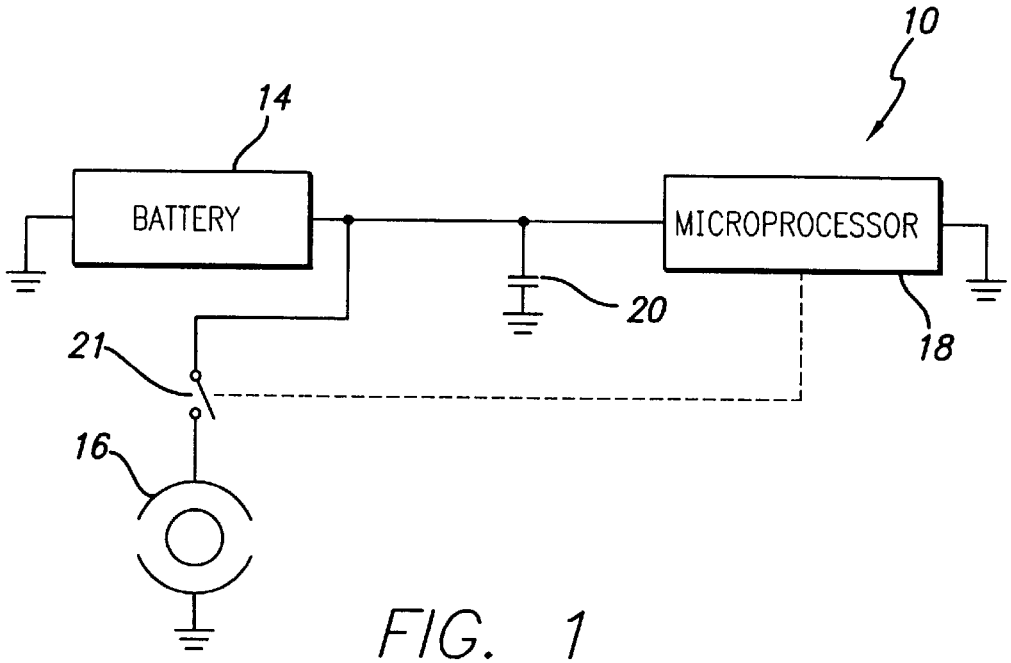
FIG. 1 PRIOR ART
FIG. 1 is an electrical diagram, partially in block form, of a system of the prior art for providing movements of a toy vehicle.
Figure 5:
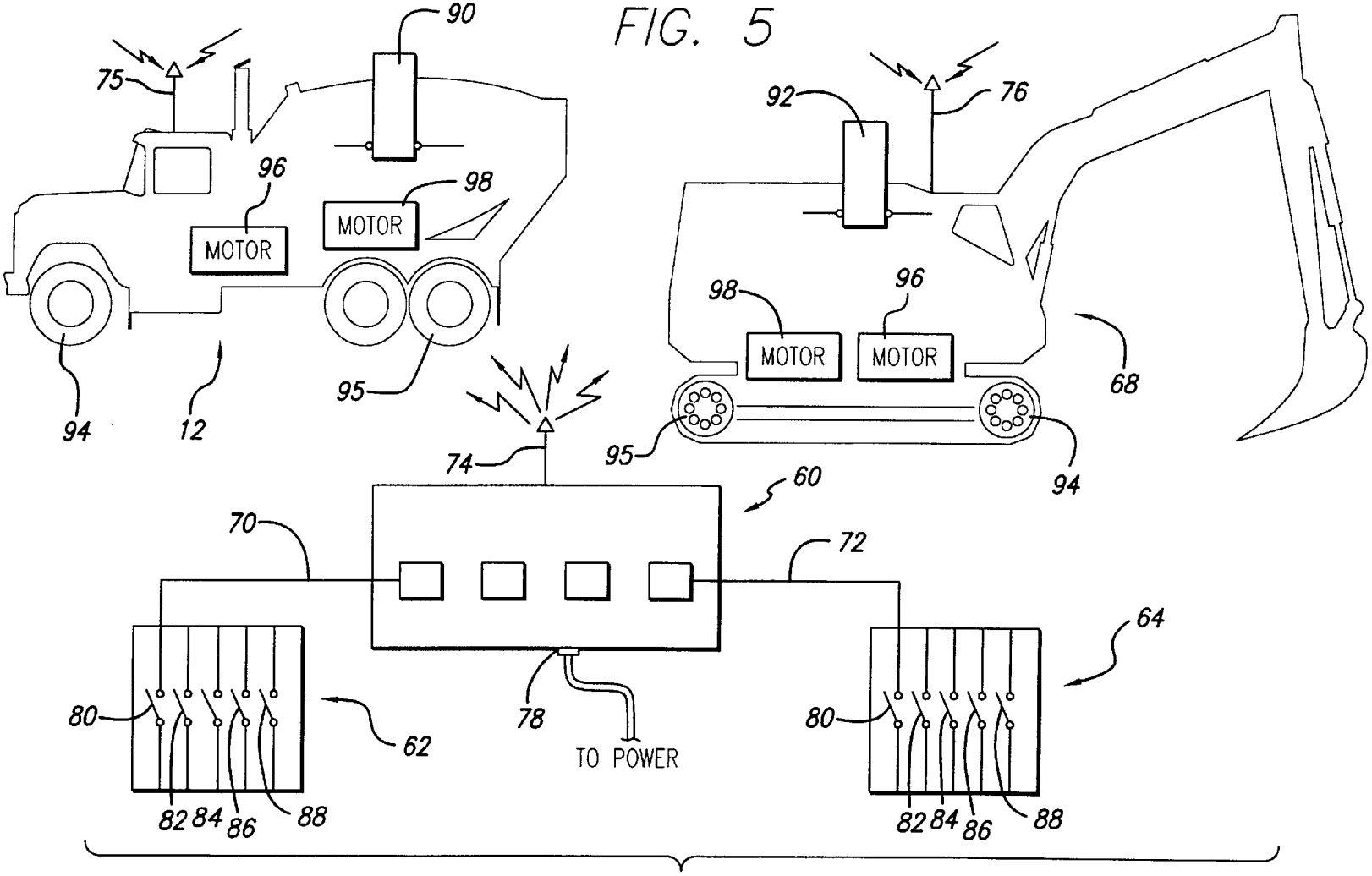
FIG. 5 is a schematic representation of a toy system, including toy vehicles, in which the electrical system shown in FIG. 3 can be used.

FIG. 1 illustrates an electrical system, generally indicated at 10, of the prior art for providing movements of a toy vehicle such as that generally indicated at 12 in FIG. 5. The system 10 is disposed in the toy vehicle 12. The system 10 includes a portable source of voltage such as a battery 14, a motor 16, a microprocessor 18, an energy storage member such as a capacitor 20 and a switch 21.

The battery 14 has two (2) terminals, one for providing a suitable voltage such as five (5) volts and the other for providing a reference voltage such as ground. The ungrounded terminal of the battery 14 is schematically shown as being connected to one terminal of the switch 21. The other terminal of the switch 21 is connected an ungrounded terminal of the motor 16 having a second terminal which provides a reference potential such as ground. Although only one motor 16 is shown in FIG. 1, two (2) motors, may be provided for the toy vehicle 12 in FIG. 5, one for the left wheels and the other for the right wheels.

The ungrounded terminal of the battery 14 is common with one terminal of the microprocessor 18. The microprocessor 18 controls the opening and closing of the switch 21. This is indicated by a broken line 24 extending between the microprocessor 18 and the movable arm of the switch 21. The undergrounded terminal of the battery 14 is also connected to the ungrounded terminal of the capacitor 20.

The vehicle 12 may have a number of individual movements at different times. These include the following: (a) acceleration in forward or rearward directions, (b) spin-turning (turning the vehicle without moving the vehicle forwardly or rearwardly), (c) turning the vehicle during the movement of the vehicle forwardly or rearwardly or (d) moving the vehicle forwardly or rearwardly at a substantially constant speed. As will be appreciated, each of such movements requires a different amount of power than the other movements. For example, starting the vehicle or accelerating the vehicle forwardly or rearwardly requires considerably more power than moving the vehicle forwardly or rearwardly at a substantially constant speed.

The microprocessor 18 determines at each instant which one of the different modes of vehicle movement is to be provided at that instant. The microprocessor 18 provides this determination at each instant to control the operation of the motor. For example, the microprocessor 18 may determine that the vehicle is to be started or to be accelerated forwardly. The microprocessor 18 communicates this determination to the switch 21 to close the switch so that the motor will operate to accelerate the vehicle forwardly.

Figure 2:
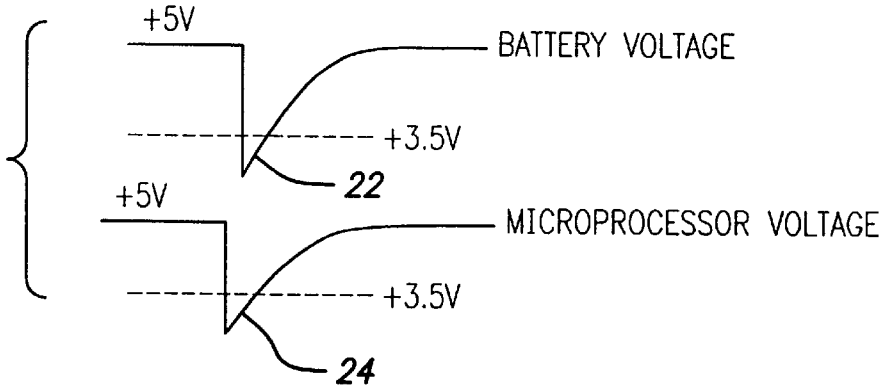
FIG. 2 PRIOR ART
FIG. 2 illustrates voltage wave forms at strategic terminals in the system shown in FIG. 1.

When the vehicle 12 is started or accelerated forwardly or rearwardly, so much energy is drained from the battery 14 that the voltage from the battery drops below a level such as approximately three and one half volts (3.5V.). This results from the current flowing through the internal resistance in the battery 14. The voltage of approximately three and one half volts (3.5V.) is indicated at 22 in FIG. 2. This voltage is not sufficient to obtain a proper operation of the microprocessor 18. Although the capacitor 20 is connected across the battery 14 to provide stored energy to the microprocessor 18, the capacitor 20 does not provide an operative voltage to the microprocessor 18 since the voltage across the capacitor is also below three and a half volts (3.5 V.) This is indicated at 24 in FIG. 2.

Figure 3:
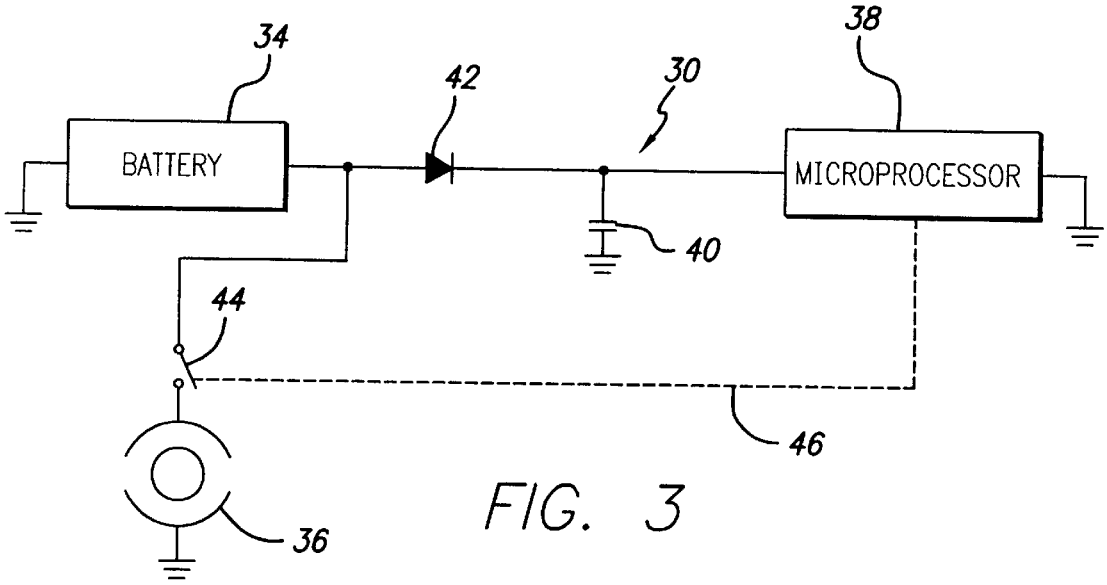
FIG. 3 is an electrical diagram, partly in block form, of a system constituting one embodiment of the invention for providing movements of a toy vehicle.

FIG. 3 illustrates a system, generally indicated at 30, for overcoming the disadvantages of the prior art system shown in FIG. 1. The system 30 includes a battery 34, a motor (or motors) 36, a microprocessor 38 and a capacitor 40 respectively corresponding to the battery 14, the motor 16, the microprocessor 18 and the capacitor 20 in FIG. 1. The system 30 in FIG. 3 corresponds to the system 10 in FIG. 1 except that a diode 42 and a switch 44 are included in the system 30.

The anode of the diode 42 is common with the ungrounded terminal of the battery 34 and the cathode of the diode has a common connection with the ungrounded terminal of the capacitor 40. The switch 44 is in a series circuit with the battery 34 and the motor 36. The opening and closure of the switch 44 is controlled by the operation of the microprocessor 38 as indicated schematically by broken lines 46 extending between the switch and the microprocessor. Although the switch 44 is shown as a mechanical switch, it will be appreciated that it may constitute other types of switches such as a transistor switch.

In each successive period of time, current passes through the diode 42 for obtaining a charging of the capacitor 40. At the same time, the microprocessor 38 opens the switch 44 to prevent the battery 34 from introducing energy to the motor 36. The percentage of time for passing current through the diode 42 and opening the switch 44 in each time period at each instant is dependent upon the mode of movement of the vehicle at that instant. As will be seen, the passage of current through the diode 42 and the closure of the switch 44 are operated on a pulse width modulation basis.

When the vehicle 12 is being started or accelerated forwardly or rearwardly, the switch 44 may be closed for a suitable period of time such as approximately ninety three percent (93%) of the time in each successive time period. Each successive time period is indicated at 48 in FIG. 4. During this time, the voltage on the anode of the diode 42 has a waveform indicated at 50 in FIG. 4. The percentage of ninety-three percent (93%) of the time in each time period 48 for the operation of the motor 36 may be considered as a portion of a duty cycle, as may be the percentage of seven percent (7%) for the charging of the capacitor 40 in each time period 48 when the switch 44 is open. During the other seven percent (7%) of the time, the voltage on the anode of the diode 42 reaches a value approaching five volts (5V.). This is indicated at 52 in FIG. 4.

Figure 4:
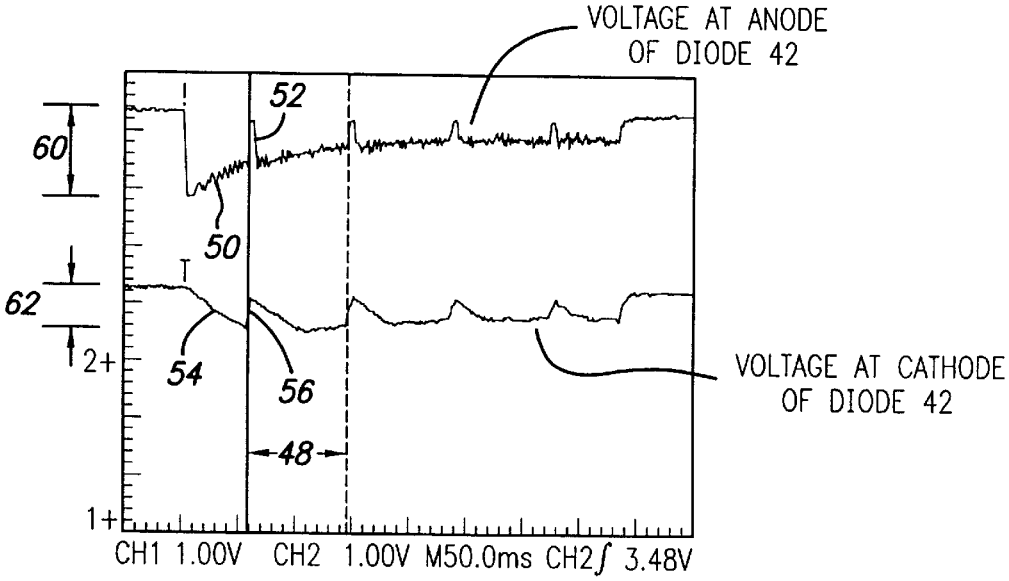
FIG. 4 illustrates voltage wave forms at strategic terminals in the system shown in FIG. 3.

The voltage on the cathode of the diode 42 is indicated at 54 in FIG. 4 during the time that the switch 44 is closed. The voltage at the cathode of the diode 42 rises to a voltage approaching five volts (5v.) during the relatively short period of time that the switch 44 is opened in each successive time period. This is indicated at 56 in FIG. 4. Because of this rapid rise in voltage and the corresponding slow fall in voltage across the capacitor 40, the voltage across the capacitor 40 never falls below three and a half volts (3.5 V.). As a result, the magnitude of the voltage across the microprocessor 38 is always sufficient to provide the desired control over the operation of the motor 36.

In one embodiment of the invention, the vehicle 12 can have two (2) different speeds. For example, one speed can be approximately one half that of the other speed. The motor 36 is preferably energized for a suitable period such as approximately ninety three percent (93%) of the time when the vehicle 12 is moving at the fast speed. This occurs whether the vehicle 12 is moving forwardly or rearwardly at the fast speed, whether the vehicle is spin turning at the fast speed or whether the vehicle is turning at the fast speed while moving forwardly or rearwardly.

The motor 36 may be energized at different percentages of the time in each time period at the slow speed depending upon the type of movement of the vehicle. For example, the motor 36 may be energized for a suitable period such as approximately fifty percent (50%) of the time in each time period 48 at the slow speed when the vehicle 12 is moving forwardly or rearwardly, for a suitable period such as approximately seventy five percent (75%) of the time in each time period when the vehicle is turning while moving forwardly or rearwardly and for a suitable period such as approximately eighty five percent (85%) of the time in each time period when the vehicle is spin turning at slow speeds.

As will be seen, the pulse width modulation for the closure of the switch 44 increases as the motor 36 is subjected to increased loads. For example, the pulse width modulation for the closure of the switch 44 is as high as approximately ninety three percent (93%) when the vehicle 12 is being started, is being accelerated forwardly or rearwardly or is being moved at the fast speed. However, even when the capacitor 40 is charged only approximately seven percent (7%) of the time in each successive time period 48, the capacitor 40 becomes charged to a magnitude significantly above three and a half volts (3.5V.). This is indicated at 56 in FIG. 4. This assures that the microprocessor 38 provides proper controls over the operation of the motor 36. Furthermore, although the motor 36 does not receive energy for some of the time in each successive time period, thereby causing the motor to coast during this time, this is not noticeable to the operator of the vehicle. This results from the fact that the torque output to the motor 36 is not reduced significantly during the time in each time period 48 that the motor is not being energized and the capacitor 40 is being charged.

The advantages in the operation of the system shown in FIG. 3 may be seen from the differences in the voltage drops shown in FIG. 4. The initial voltage drop at the anode of the diode 42 is indicated at 60 in FIG. 4. As will be seen, this voltage drop is quite [steep] large. In contrast, the voltage drop at the cathode of the diode 42 is relatively small. This relatively small voltage drop is indicated at 62 in FIG. 4. Because of the relatively small voltage drop 62 at the cathode of the diode 42, the microprocessor 38 is able to control the operation of the motor 36.

The system 30 shown in FIG. 3 and described above is adapted to be used in a system disclosed and claimed in co-pending application Ser. No. 08/763,675 filed by William M. Barton, Jr., Paul Eichen and Peter C. DeAngelis on Dec. 11, 1996, for a "System For, and Method Of, Selectively Providing the Operation of Toy Vehicles" and assigned of record to the assignee of record of this application. The system disclosed and claimed in co-pending application Ser. No. 08/763,678 is shown on a simplified basis in FIG. 5 and this simplified basis is described below. Reference should be made to co-pending application Ser. No. 08/763,678 to complete the disclosure in this application with respect to the showing in FIG. 5 if it is believed that details necessary or desirable to complete the disclosure in this application with respect to FIG. 5 are missing from FIG. 5.

The system shown in FIG. 5 includes a central station generally indicated on a simplified basis at 60, a pair of hand held pads generally indicated on a simplified basis respectively at 62 and 64 and a pair of vehicles generally indicated on a simplified basis respectively at 12 and 68. The central station 60 communicates with the pads 62 and 64 by wires 70 and 72 respectively connected between the central station and the pads. The central station 60 has an antenna 74 which transmits address and control signals to antennas 75 and 76 respectively on the vehicles 12 and 68. The central station 60 has a plug 78 which is disposed in a wall socket (not shown) to apply a voltage to the central station and the pads 62 and 64.

The central station 60 interrogates the pads 62 and 64 on a cyclic basis to determine if each of the pads has addressed one of the vehicles 12 and 68. Each of the pads 62 and 64 has a switch 80 which is manually activated. A single activation of the switch 80 on one of the pads 62 and 64 causes the vehicle 12 to be addressed by that pad. Two (2) activations of the switch 80 on one of the pads 62 and 64 within a particular period of time causes the vehicle 68 to be addressed by that pad. For example, a user may activate the switch 80 in the pad 62 twice within the particular period of time to address the vehicle 68 for operation by that pad. When the user of the pad 62 addresses the vehicle 68, the user of the pad 62 continues to operate the vehicle until such time as the user of the pad no longer wishes to operate the vehicle. The user of the pad 62 also operates a plurality of switches 82, 84, 86 and 88 on the pad 62 to control the movements of the addressed vehicle 68.

The vehicles 12 and 68 are provided with sockets to receive a key such as indicated at 90 and 92. Each of the keys 90 and 92 is constructed to close switches in a vehicle in a pattern individual to that key. In this way, each of the keys provides a vehicle with an address individual to that key when the key is inserted in a socket in the vehicle. For example, the key 90 may close the second and fourth of four (4) switches in the vehicle 12 when the key is inserted into the socket in the vehicle. These switch closures provide a distinctive address to the vehicle 12. Similarly, the key 92 may close the second and third switches in one of the vehicles 12 and 68 when inserted into the socket in the vehicle.

Each of the vehicles 12 and 68 has at least a pair of front wheels 94 mounted on a first axle and at least a pair of rear wheels 95 mounted on a second axle displaced from the first axle. The closure of the switch 82 in the pad addressing one of the vehicles causes a motor 96 in the vehicle to rotate the left wheels on the chassis in the vehicle in a direction providing for a forward movement of the vehicle. The closure of the switch 84 in the pad addressing the vehicle causes the motor 96 in the vehicle to rotate the left wheels on the chassis in the vehicle in a direction providing for a rearward movement of the vehicle. In like manner, the closure of respective ones of the switches 86 and 88 in the pad addressing the vehicle causes a motor 98 in the vehicle to rotate in directions respectively providing for a forward or rearward movement of the vehicle. The motors 96 and 98 are considered the equivalent of the motor 36 in FIG. 3.

When the switches 82 and 86 in the pad addressing a vehicle are simultaneously closed, the motors 96 and 98 will provide an acceleration of the vehicle in the forward direction if the vehicle is stationary or is traveling at a reduced rate of speed. The motors 96 and 98 will maintain the vehicle at a constant speed in the forward direction if the vehicle is already traveling at the maximum speed in the forward direction. In like manner, the simultaneous closure of the switches 84 and 88 will cause the motors 96 and 98 to rotate the wheels for providing a movement of the vehicle in the rearward direction.

When it is desired to turn the vehicle while the vehicle is moving forwardly, only one of the motors 96 and 98 is operated. For example, when it is desired to turn the vehicle to the left, only the motor 98 is operated. Similarly, only the motor 96 is operated when it is desired to turn the vehicle to the right. For a spin-turning operation, the motor 96 is operated to move the left wheels on the vehicle in one direction and the motor 98 is operated to move the right wheels on the vehicle in the opposite direction. For example, the vehicle spin-turns to the right when the motor 96 rotates the left wheels for movement of the vehicle in the forward direction and the motor 98 rotates the right wheels for movement of the vehicle in the rearward direction.

As previously described, the microprocessor 38 determines, in accordance with the signals from the central station 60 indicating the closure of the switches 82,84,86 and 88, whether the vehicle is to move forwardly or rearwardly, turn to the right or the left or spin-turn to the right or the left. The microprocessor 38 then produces a closure of the switch 44 at each instant in relative percentages of time in each successive time period 48, these relative percentages being dependent upon the type of movement to be imparted to the vehicle at such instant.

Applicants have used the word "vehicle" in the specification and claims in this application in a broad sense consistent with the definition of the word "vehicle" in various dictionaries. For example, Webster's New Collegiate Dictionary copyrighted in 1976 defines "vehicle" as a "means of carrying or transporting something" and also as "an agent of transmission". Webster's Third New International Dictionary copyrighted in 1993 also defines a "vehicle" as "a means of carrying or transporting something" and additionally defines "vehicle" as "a container in which something is conveyed" and as "a carrier of goods and passengers".

Although this invention has been disclosed and illustrated with reference to particular embodiments, the principles involved are susceptible for use in numerous other embodiments which will be obvious to persons of ordinary skill in the art. The invention is, therefore, to be limited only as indicated only by the scope of the appended claims.

What is claimed is:

1. In combination for use in a toy vehicle, a battery, motor means connected to the battery to be energized by the battery in driving the toy vehicle, a capacitor connected in a circuit with the battery to be charged by the battery, a microprocessor connected to the capacitor to be energized by the charge in the capacitor and coupled to the motor means to provide for the operation of the motor means, in each of successive time periods of substantially equal duration, for a first portion of the time dependent upon the operation to be provided by the motor means in driving the toy vehicle during that time period, and means connected in the circuit with the battery and the microprocessor for providing for the operation of the motor means in driving the toy vehicle during the first portion of the time in each successive time period and for providing for the charging of the capacitor by the battery, during a second portion of the time in the time period different from the first portion of the time in the time period, when the motor means is not driving the toy vehicle.

2. In a combination as set forth in claim 1 wherein the microprocessor determines at each instant whether the toy vehicle is to be accelerated, turned while moving forwardly or rearwardly, spin-turned or moved at a substantially constant speed and wherein the microprocessor provides changes in the first portion of the time in each of the successive time periods for the operation of the motor means, and in the second portion of the time in each of the successive time periods for the charging of the capacitor, in accordance with the determination by the microprocessor.

3. In a combination as set forth in claim 2 wherein the first portion of the time in each of the successive time periods provides a different percentage of the time in the time period for each of toy vehicle acceleration, toy vehicle spin-turning, toy vehicle turning during the movement of the toy vehicle in the forward or rearward directions and toy vehicle movements at a substantially constant speed.

4. In a combination as set forth in claim 1 wherein the means connected in the circuit with the battery and the microprocessor includes a diode connected between the battery and the microprocessor to provide for a charging of the capacitor by the battery in the second portion of the time in each of the successive time periods of substantially equal duration and to prevent the charging of the capacitor by the battery during the first portion of the time in each of the successive time periods of substantially equal duration.

5. In combination, a toy vehicle, a battery disposed in the toy vehicle, motor means disposed in the toy vehicle and connected in a circuit with the battery to be energized by the battery for moving the toy vehicle at different times with accelerations or with substantially constant movements, an energy storage member for storing energy from the battery, a microprocessor connected to the energy storage member and coupled to the motor means for determining times for the accelerations or substantially constant movements of the toy vehicle in straight or turning paths and, dependent upon such determinations, for providing energizings of the motor means from the battery in successive time periods of substantially constant duration, and means connected in a circuit with the battery and the microprocessor for providing for an operation of the microprocessor in each successive time period to obtain an energizing of the motor means by the battery during a first portion of the time in each successive time period as determined by the microprocessor and to obtain a charging of the energy storage member by the battery in a second portion of the time in each successive time period where the second portion of the time in each successive time period occurs after the first portion of the time in the time period.

6. In a combination as set forth in claim 5 wherein the microprocessor provides the successive time periods of the substantially constant duration for the energizings of the motor means and the charging of the energy storage member and provides individual values for the first portion of the time in each of the successive time periods for the operation of the toy vehicle in individual ones of acceleration, spin-turning, turning while moving forwardly or rearwardly and substantially constant movements in a straight line path.

7. In a combination as set forth in claim 6 wherein the battery introduces energy to the energy storage member in the second portions of the times in the successive time periods when the motor means is not operated to provide individual ones of acceleration, spin turning, turning of the toy vehicle during the movements of the toy vehicle in the forward or rearward directions and substantially constant movements in the straight line path.

8. In a combination as set forth in claim 7, wherein the means connected in the circuit with the battery and the microprocessor includes a diode providing a low impedance path from the battery to the energy storage member for the second portions of the time in each of the successive time periods and providing a high impedance path from the battery to the energy storage member in the first portions of the time in each of the successive time periods.

9. In combination, a toy vehicle having front and rear axles and members mounted on the front and rear axles and operable in directions for providing a movement of the toy vehicle in accordance with the directions in which the members are operated, a switch having open and closed states and operative in the closed state for operating the members in directions to provide for individual modes of operation of the toy vehicle including an acceleration of the toy vehicle in forward or rearward directions, a spin-turning of the toy vehicle to the right or left, a turning of the toy vehicle to the right or left during the movement of the toy vehicle in the forward or rearward directions, and substantially constant movements of the toy vehicle in the forward or rearward directions, a battery, motors connected to the battery for energizing by the battery and operatively coupled to the switch for providing for a movement of the toy vehicle in the different modes in accordance with the closure of the switch and the pattern of operations of the motors during the closure of the switch, an energy storage member connected in a circuit with the battery to store energy from the battery when the voltage from the battery is greater than the voltage in the energy storage member, a microprocessor connected to the energy storage member and coupled to the motors for receiving energy from the energy storage member and for determining the mode of operation of the motors at each instant and for closing the switch, in each of successive time periods of a substantially constant duration, for an individual percentage of time dependent upon the mode of operation of the motors in each of the successive time periods of the substantially constant duration and a control member connected in a circuit with the battery and the microprocessor for introducing energy from the battery to the energy storage member, in each of the successive time periods, in the portion of the time when the switch is not closed and when the voltage from the battery is greater than the voltage in the energy storage member.

10. In a combination as set forth in claim 9, the microprocessor being operative to provide for the operation of the motors during the time in each successive time period before the time in each successive time period that the battery is introducing energy to the energy storage member.

11. In a combination as set forth in claim 10, the microprocessor being operative to increase progressively, in the successive time periods of substantially constant duration, the individual percentage of the time for the transfer of energy from the battery to the motors for the modes of (a) accelerating the vehicle in the forward or rearward directions, (b) spin-turning the toy vehicle to the right or left, (c) turning the toy vehicle to the right or the left during the movements of the toy vehicle in the forward or rearward directions and (d) providing substantially constant movements of the toy vehicle in the forward and rearward directions.

12. In a combination as set forth in claim 9, a member constructed to provide a low impedance in a first direction and a high impedance in a second direction opposite to the first direction, the member being disposed to provide the low impedance in the direction from the battery to the energy storage member.

13. In combination for use in a toy vehicle, a battery, a diode, a capacitor, the battery, the diode and the capacitor being connected in a series circuit, motive means for moving the toy vehicle, a switch having open and closed states and disposed in a series circuit with the battery and the motive means, and a microprocessor connected across the capacitor and operatively coupled to the switch to selectively operate the switch in the closed state in first portions of the times in successive periods of time of substantially constant duration and to selectively operate the switch in the open state in second portions of times in the successive periods of time different from the first portions of the times in the successive periods of time.

14. In a combination as set forth in claim 13, the toy vehicle having different modes of operation including acceleration in forward or rearward directions, spin-turning, turning during movements of the toy vehicle in the forward or rearward directions and movements of the toy vehicle in the forward or rearward directions at substantially constant speeds, the microprocessor being responsive in each of the successive periods of time to individual ones of the different modes of operation of the toy vehicle for providing for the operation of the switch in individual ones of the open and closed states for individual portions of the time in each of such sequential periods of time.

15. In a combination as set forth in claim 14 wherein the energy is provided from the battery to individual ones of the motive means in the first portion of the time in the successive time periods and wherein the first portion of the time in each of the successive time periods for the introduction of the energy to the individual one of the motive means is dependent upon the speed of movement of the toy vehicle and upon the operation of the motive means in providing the following movements of the toy vehicle: (a) acceleration in forward or rearward directions, (b) spin-turning, (c) turning during movements of the toy vehicle in the forward or rearward directions, and (d) movements of the toy vehicle in the forward or rearward directions at substantially constant speeds.

16. In a combination as set forth in claim 15 wherein the first portion of the time each of the successive time periods for the introduction of energy to the motive means, for particular speeds of movement of the motor, is greater for acceleration in forward or rearward directions than spin-turning, greater for spin-turning than turning during movements of the toy vehicle in the forward or rearward directions and greater for turning of the toy vehicle in the forward or rearward directions than movements of the toy vehicle in the forward or rearward directions at substantially constant speeds and wherein the second portion of the time in each of the successive time periods for the introduction of energy to the capacitor, for the particular speeds of movement of the motor, is greater for spin-turning than for acceleration in the forward or rearward directions, greater for turning movements of the toy vehicle during movements of the toy vehicle in the forward or rearward directions than for spin-turning and greater for movements of the toy vehicle in the forward or rearward directions at substantially constant speeds than for turnings of the vehicle during the forward or rearward movements of the toy vehicle.

17. In a combination as set forth in claim 15 wherein the first portion of the time in each of the successive time periods for the introduction of energy to the motive means, for particular speeds of movement of the toy vehicle, is different for each of (a) acceleration in forward or rearward directions, (b) spin-turning, (c) turning during movements of the toy vehicle in the forward or rearward directions and (d) movements of the toy vehicle in the forward or rearward directions at substantially constant speeds.

18. In a combination as set forth in claim 16 wherein the particular speeds constitute first particular speeds and wherein the portion of the time in each of the successive time periods for the introduction of energy to the motive means, for second particular speeds of movement of the toy vehicle, is different for each of (a) acceleration in the forward or rearward directions, (b) spin-tuning, (c) turning during movements of the toy vehicle in the forward or rearward directions and (d) movements of the toy vehicle in the forward or rearward directions at substantially constant speeds.

19. In combination, a toy vehicle, a portable source of a direct voltage in the toy vehicle, a control member in the toy vehicle, an energy storage member in the toy vehicle, the direct voltage source, the control member and the energy storage member being connected in a series circuit, motive means in the toy vehicle for moving the toy vehicle, a switch disposed in the toy vehicle and having open and closed states and disposed in a circuit with the direct voltage source and the motive means for providing for an operation of the motive means when the switch is closed and for providing for a charging of the energy storage member when the switch is open, and a microprocessor connected to the energy storage member to receive a voltage from the energy storage member and coupled to the switch to selectively operate the switch in the closed state at first portions of successive periods of time of substantially constant duration and to operate the switch in the open state at second portions of time in the successive time periods where the second portions of the time in the successive time periods are different from the first portions of the time in the successive time periods.

20. In a combination as set forth in claim 19, the toy vehicle having different modes of operation including acceleration in forward or rearward directions, spin-turning, turning during movements of the toy vehicle in the forward or rearward directions and movements of the toy vehicle in the forward or rearward directions at substantially constant speeds, the microprocessor being responsive in each of the successive periods of time to individual ones of the different modes of operation of the toy vehicle for providing for the operation of the switch in individual ones of the open and closed states for individual portions in each of such sequential periods of time.

21. In a combination as set forth in claim 19 wherein the energy is provided from the direct voltage source to individual ones of the motive means in the first portion of the time in each of the successive time periods and wherein energy is provided from the direct voltage source in each of the successive time periods to the energy storage member in the second portion of the time in each of the successive time periods where the second portion of the time in each of the successive time periods is different from the first portion of the time in each of the successive time periods and wherein the first portion of the time in each of the successive time periods is dependent upon the operation of the motive means in providing an individual one of (a) acceleration of the toy vehicle in forward or reverse directions, (b) spin-turning of the toy vehicle, (c) turning of the toy vehicle during movements of the toy vehicle in the forward or rearward directions and (d) movements of the toy vehicle in the forward or rearward directions at a substantially constant speed.

22. In a combination as set forth in claim 19 wherein the direct voltage source, the control member and the energy storage member are in a series circuit and wherein the microprocessor is in parallel with the energy storage member and wherein the direct voltage source, the switch and the motive means are in a series circuit when the switch is closed.

23. In a combination as set forth in claim 22 wherein the direct voltage source is a battery and the energy storage member is a capacitor.

24. In a combination as set forth in claim 21 wherein the direct voltage source, the control member and the energy storage member are in a series circuit and wherein the microprocessor is in parallel with the energy storage member and wherein the direct voltage source, the switch and the motive means are in a series circuit when the switch is closed and wherein the direct voltage source is a battery and the energy storage member is a capacitor.

* * * * *

UNITED STATES PATENT AND TRADEMARK OFFICE

CERTIFICATE OF CORRECTION

PATENT NO. : 6,139,399
DATED : October 31, 2000
INVENTOR(S) : Peter C. DeAngelis It is certified that error appears in the above-identified patent and that said Letters Patent is hereby corrected as shown below:

Column 1,
Line 5, before "This ...", add -- This is a continuation of application Serial No. 09/017,922 filed on February 3, 1998 --.

Column 5,
Line 16, change "08/763,675", to read -- 08/763,678 --.

Column 8,
Lines 6 and 7, after "and" delete ", dependent upon such determinations," and move that statement to line 10 immediately after "duration".

Column 10,
Line 13, change "sequential", to read -- successive --.

Signed and Sealed this

Seventh Day of May, 2002

*Attest:*

*Attesting Officer*

JAMES E. ROGAN
*Director of the United States Patent and Trademark Office*